US005687853A

United States Patent [19]

Askew

[11] Patent Number: 5,687,853

[45] Date of Patent: Nov. 18, 1997

[54] SCREEN CONSTRUCTION

[75] Inventor: Terry Ronald Askew, Dudley, Australia

[73] Assignee: Hunter Wire Products Limited, New South Wales, Australia

[21] Appl. No.: 525,812

[22] Filed: Jul. 26, 1995

[30] Foreign Application Priority Data

Jul. 28, 1994 [AU] Australia ..... PM7130

[51] Int. Cl.[6] ..... B07B 1/49

[52] U.S. Cl. ..... 209/393; 209/675

[58] Field of Search ..... 209/393, 395, 209/405, 408, 412, 675, 677

[56] References Cited

U.S. PATENT DOCUMENTS

| | | | |
|---|---|---|---|
| 2,142,600 | 1/1939 | Bixby | 209/393 |
| 2,150,889 | 3/1939 | Bixby | 209/393 X |
| 2,288,883 | 7/1942 | Bixby | 209/393 |
| 3,777,893 | 12/1973 | Ginaven | 209/393 X |
| 3,901,801 | 8/1975 | Bixby | 209/395 |
| 5,219,078 | 6/1993 | Hadden | 209/393 X |
| 5,415,294 | 5/1995 | Nagaoka | 209/393 |

FOREIGN PATENT DOCUMENTS

| | | | |
|---|---|---|---|
| 6094790 | 11/1990 | Australia . | |
| 1102336 | 10/1955 | France | 209/393 |
| 697204 | 11/1979 | U.S.S.R. | 209/395 |

*Primary Examiner*—David H. Bollinger

*Attorney, Agent, or Firm*—Sidley & Austin

[57] ABSTRACT

A screening panel molded in one piece in plastics material has a plurality of surface members 11 running generally in the direction 'A' and supported on transverse members 12. The surface members 11 define a substantially raised surface having a plurality of slots or gaps 13 of substantially constant dimension through which material to be screened will pass if it is below the screen size defined by the gaps 13. The surface members 11 project a significant distance above the transverse members 12 in order to provide a surface having substantially uninterrupted slots 13. The structure and material are designed to increase flexibility of the panel which assists in keeping the panel clear without any significant degradation of the sizing capability of the screen. The panel has three flexing modes which assist in clearing the panel, these being horizontal bending of the surface members 11 in the direction 'B', vertical bending of the members 11 in the direction 'C', and twisting of the members 11 about the longitudinal axis.

8 Claims, 6 Drawing Sheets

SCREEN CONSTRUCTION

FIELD OF THE INVENTION

The present invention relates generally to industrial screening systems and in particular the invention provides a new screen construction with improved properties.

BACKGROUND OF THE INVENTION

Vibrating screens are used in a variety of industrial and mining applications to separate and size material being processed. Traditionally such screens were of woven wire construction, although more recently welded wedge wire screens have also become popular particularly for smaller sizing applications.

A drawback of metal screens has always been their rate of wear with screen elements having to be replaced frequently.

Even more recently, polyurethane screens have been designed which because of their resilient nature have exhibited better wear characteristics than traditional metal screens, however polyurethane screens typically have the drawback that they have a lower open area ratio than metal screens, which reduces throughput, and they can be prone to blinding with some process materials or alternatively they are too flexible and pass unacceptable levels of oversize material. Each of these drawbacks are partially or wholly because of the location of cross members flush with the upper surface of the screen to accurately maintain the apperture and provide structural strength.

SUMMARY OF THE INVENTION

The present invention consists in a screen panel for use in vibrating screening equipment, the panel comprising a plurality of screen surface members running in a first direction and a plurality of underlying supporting members running substantially transversely of and connected to each of the surface members to locate the surface members relative to one another and to provide structural strength, each surface member separated from its adjacent surface members by gaps having a dimension defining the discriminating size of the screen panel, and the surface members protruding above the transverse members to provide a plurality of open slots at the surface of the panel over a substantial part of its length.

Preferably the screen panel is formed in a resilient plastics material such as polyurethane and the transverse members run generally perpendicular to the average direction of the surface members and are spaced below the surface of the panel by a distance which is not less than the distance separating the surface members.

In a particularly preferred embodiment of the invention the surface members are not straight, but are formed with a regular repeating deviation in the horizontal plane. Preferably the surface members are formed with a wave pattern having an amplitude which is a small multiple of the gap between the surface members and a wavelength which is approximately an order of magnitude greater than the amplitude. The wave pattern may be a sinusoidal, triangular or circular wave shape or any similar shape.

The surface members in the preferred embodiment will have a substantially rectangular profile with a slight taper, in the range of 0° to 13° in the bottom third of the member. The taper angle is selected to suit aperture size and the application of the screen. In at least one advantageous form of the invention the taper is approximately 6°.

BRIEF DESCRIPTION OF THE DRAWINGS

Embodiments of the invention will now be described, by way of example with reference to the accompanying drawings in which.

DETAILED DESCRIPTION OF THE PREFERRED EMBODIMENTS

Figure 1:
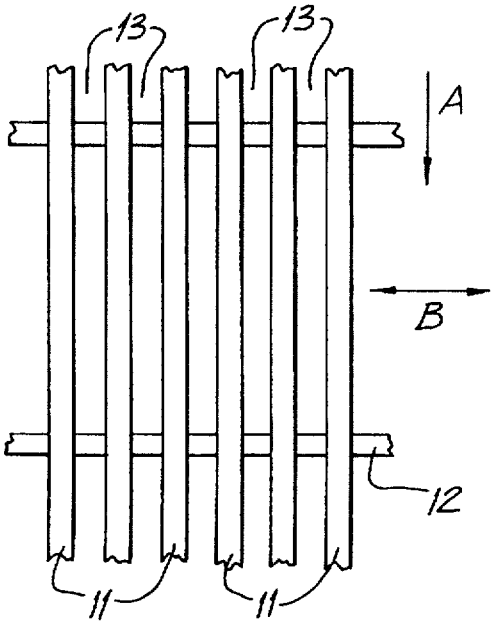
FIG. 1 is a top view of a portion of a screening panel mode in accordance with a first embodiment of the invention.

Referring to FIG. 1, a top view of a section of screening panel is illustrated. The panel is intended to be mounted in such a way that material to be screened will flow over the panel generally in the direction of arrow 'A'.

The panel comprises a plurality of surface members 11 running generally in the direction 'A' and supported on transverse members 12. The surface members 11 define a substantially raised surface having a plurality of slots or gaps 13 of substantially constant dimension through which material to be screened will pass if it is below the screen size defined by the gaps 13.

Figure 2:
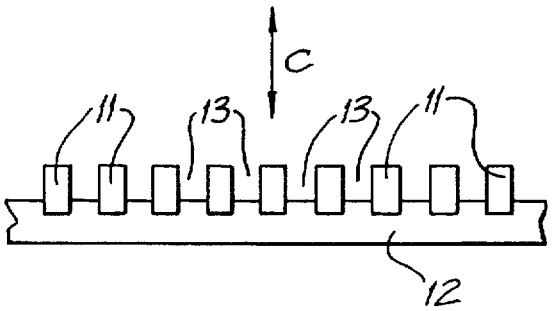
FIG. 2 is an end view of a portion of the panel of FIG. 1.
Figure 3:
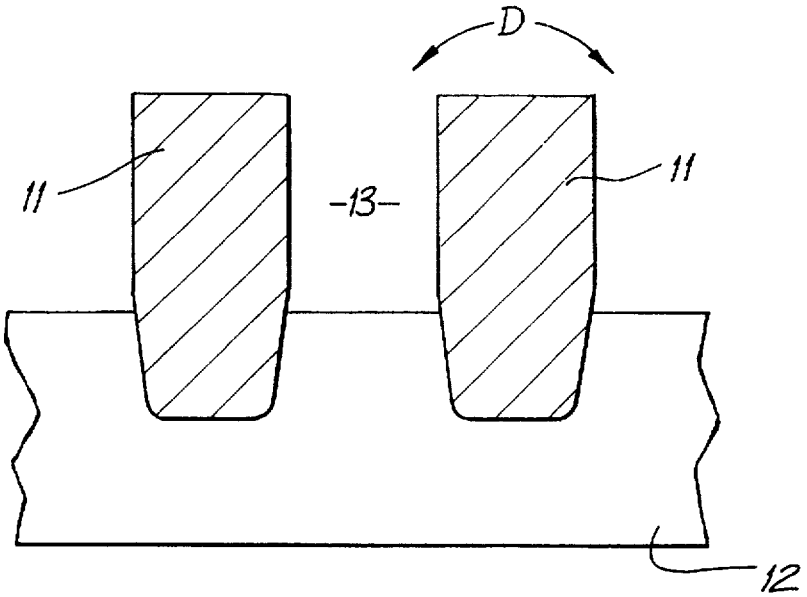
FIG. 3 is a detail of the end view of FIG. 2.

Referring to FIGS. 2 and 3 which are both end views of the surface members 11, it will be noted that the surface members 11 project a significant distance above the transverse members 12 in order to provide a surface having substantially uninterrupted slots 13. It has not previously been known to manufacture panels out of plastics material, and more specifically polyurethane, in such a configuration. Polyurethane panels in the past have typically been manufactured with both the longitudinal and transverse members extending to the top surface of the panel to provide rigidity and strength. Such a structure was considered necessary in polyurethane panels in order to maintain accurate sizing, because excessive flexibility would lead to oversized material passing through the screen. These prior art screens suffer from problems with blinding where material builds up against transverse members at the downstream ends of each slot, and eventually closes the entire slot. This problem is particularly severe in some operating environments and can lead to screens requiring cleaning several times a day, with significant loss of throughput resulting.

The screen of FIGS. 1–3 has several characteristics which enable it to overcome the blinding problems of prior art screens. First, because the transverse members 12 are located below the surface of the screen, the slots 13 are open along their entire length, thereby reducing the opportunity for buildup to occur. This feature can be enhanced if panels are manufactured in such a way that the slots 13 are open through the ends of the panel and slots from one panel line up with slots in the next panel.

The second feature of the panel of FIGS. 1–3 which enhances its performance is that the increased flexibility of the panel assists in keeping the panel clear without any significant degradation of the sizing capability of the screen. The panel of FIGS. 1–3 has three flexing modes which assist in clearing the panel, these being horizontal bending of the surface members 11 in the direction 'B' (ref FIG. 1), vertical bending of the members 11 in the direction 'C' (refer FIG. 2), and twisting of the members 11 about the longitudinal axis as indicated by 'D' in FIG. 3. It will be recognised that the bending motions 'B' and 'C' will be greatest between the transverse members 12 with little or no motion at the transverse members, but the twisting motion 'D', while reduced at the transverse members, can occur along the entire length of the surface members and significantly enhances their clearing efficiency.

The surface members 11 preferably have a substantially rectangular profile with a slight taper, as seen in FIG. 3, in the range of 0° to 13° in the bottom third of the member. The taper angle is selected to suit aperture size and the application of the screen. In one form, the taper is preferably approximately 6°.

Figure 4:
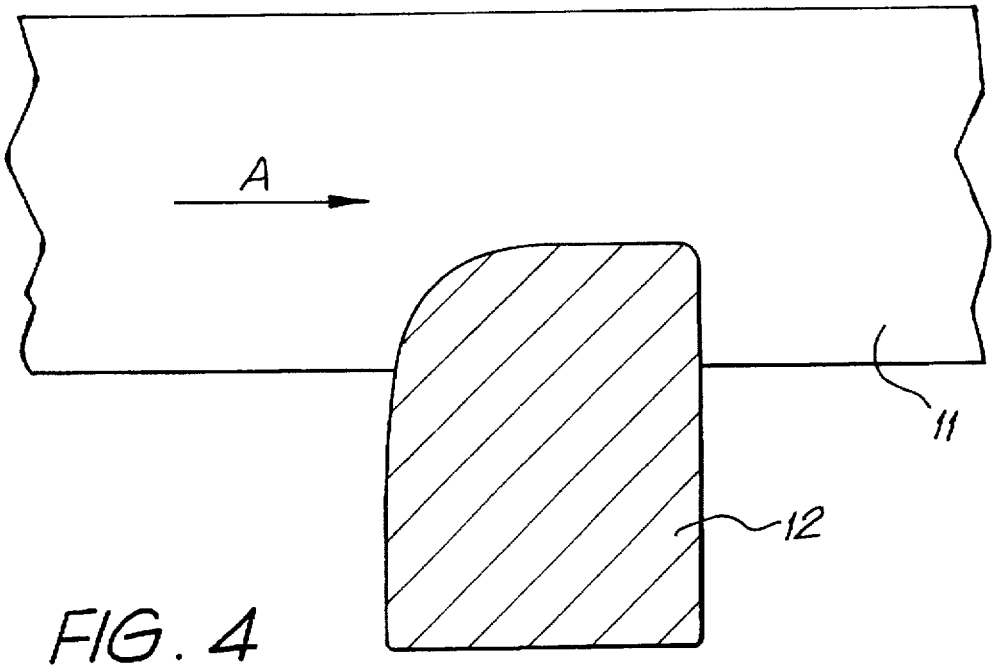
FIG. 4 is a detail of a sectional side view of the panel of FIG. 1.

Referring to FIG. 4, a detail is illustrated of a cut away side view of a transverse member 12 of the panel of FIG. 1. It will be seen that the profile of the transverse member 12 is champhered or rounded on its upper leading edge to deflect material over the transverse member. Alternative embodiments may have the leading edge running backwards away from the direction of flow to deflect buildup through the screen.

Figure 5:
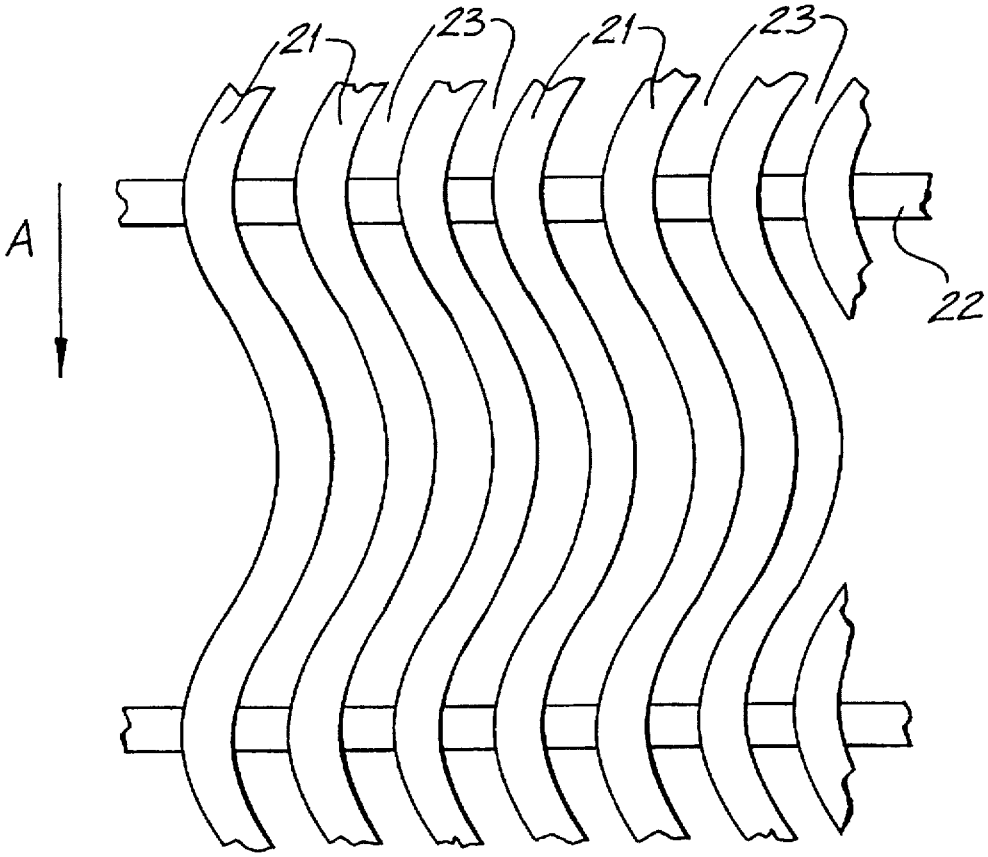
FIG. 5 is a top view of a portion of a screening panel made in accordance with a second embodiment of the invention.
Figure 12:
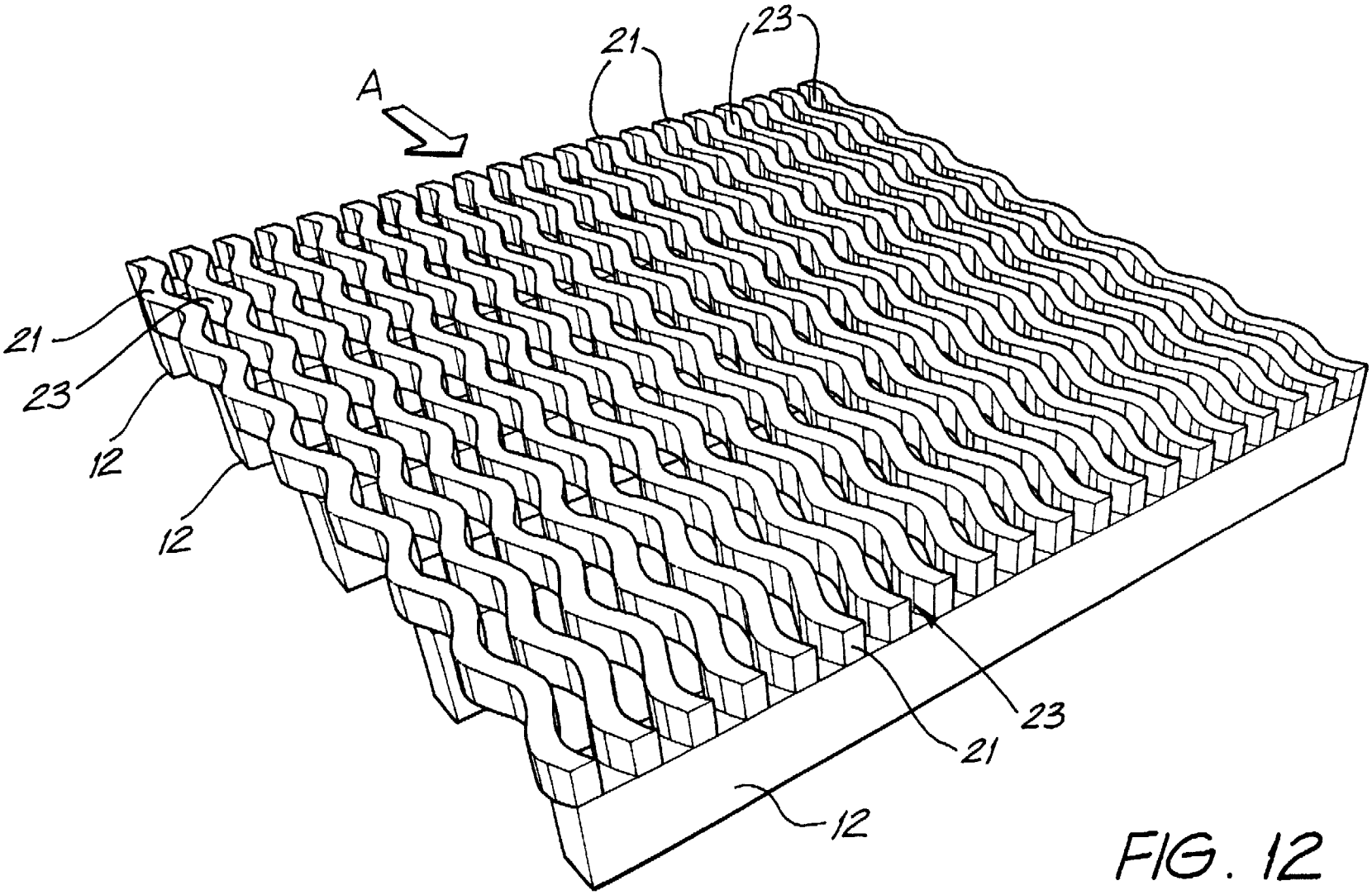
FIG. 12 is a perspective view of the panel of FIG. 5.

Turning now to FIG. 5, an alternative embodiment is illustrated in which the surface members 21 (corresponding to members 11 of FIG. 1) are shaped in the longitudinal direction with a repeating wave pattern. A perspective view of a similar embodiment is shown in FIG. 12. As illustrated the wave pattern has an amplitude in the range of 10%–20% of the wavelength, however, it will be recognized that advantageous effects may be obtained with wave pattern amplitude of from 0–50% of the wave length, depending upon the application. In the illustrated embodiment the wavelength of the pattern is approximately 10 times the gap width 23 but might range from a fraction of the gap width to an essentially infinite multiple of the gap width (in the case of a substantially straight pattern) again depending on the application.

The application between the spacing of the transverse members 12 and the wavelength of the surface members 21 will also vary depending upon the application, but the transverse member spacing may vary from approximately 1–3 wavelengths.

The additional advantage provided by the embodiment of FIG. 5 is that additional flexibility is provided by virtue of the wave pattern thereby improving the clearing characteristics of the panel. At the same time, sizing is improved because elongated particles which might otherwise have aligned with surface members 11 of FIG. 1 and wedged their way through the screen will be blocked by the screen of FIG. 5 due to the bends in the slots 23. Longer particles will therefore lay across the curved members 21 and will be less likely to enter the gap.

The screen of FIG. 5 is shown with the wave pattern of adjacent surface members 21 in phase, however in an alternative embodiment the waver patterns of adjacent members 21 may be out of phase by 180° (½ wavelength) in which case the wide portions of each slot will form apertures which are approximately square, providing improved sizing in some circumstances.

In the embodiment of FIG. 5 and the alternative, out of phase, embodiment, the motion of the machine and the material being screened creates an oscillation in the members 21 in the longitudinal direction 'A' which enhances the clearing of the screen. A similar effect could be expected in the embodiment of FIG. 6 and other wave pattern embodiments.

Figure 6:
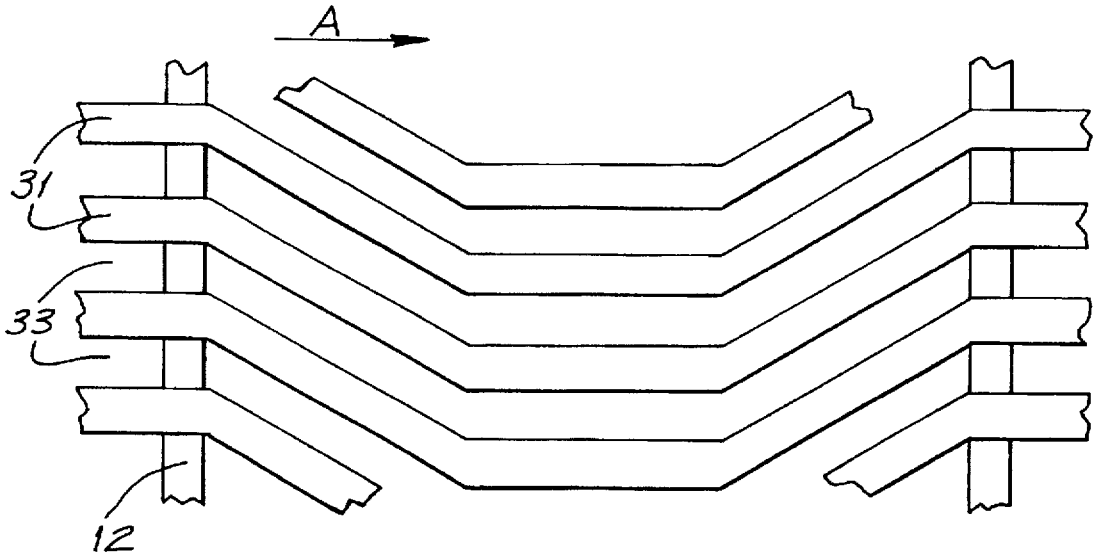
FIG. 6 is a top view of a portion of a screening panel made in accordance with a third embodiment of the invention.
Figure 7:
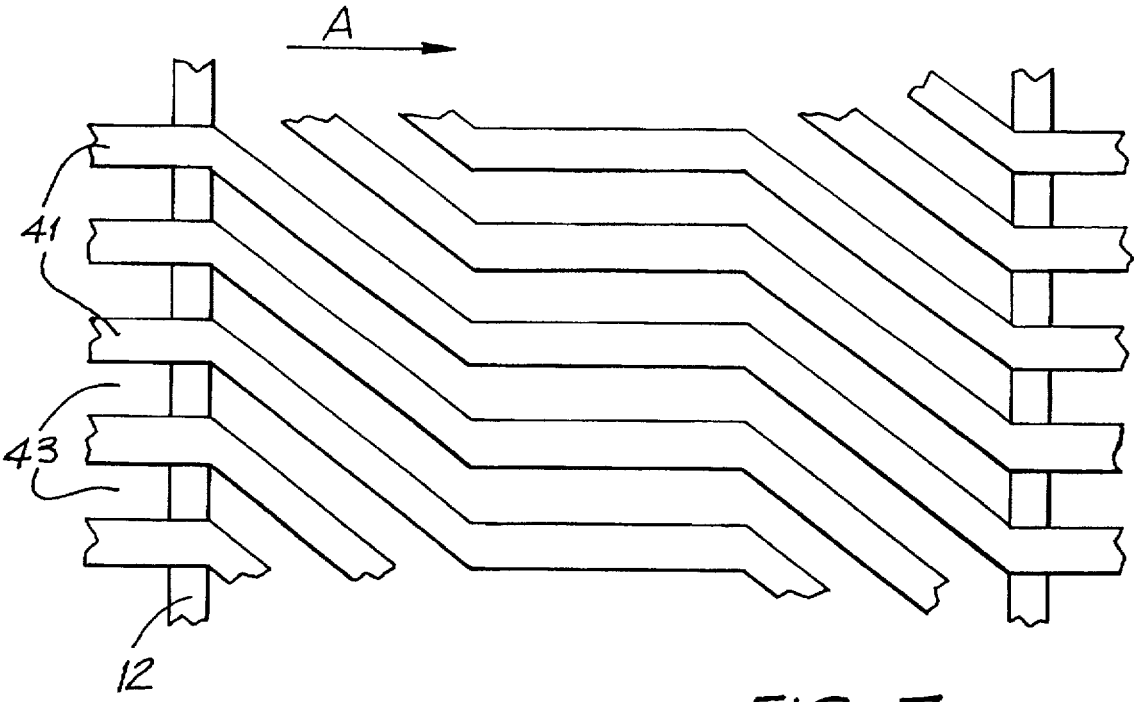
FIG. 7 is a top view of a portion of a screening panel made in accordance with a fourth embodiment of the invention.
Figure 8A:
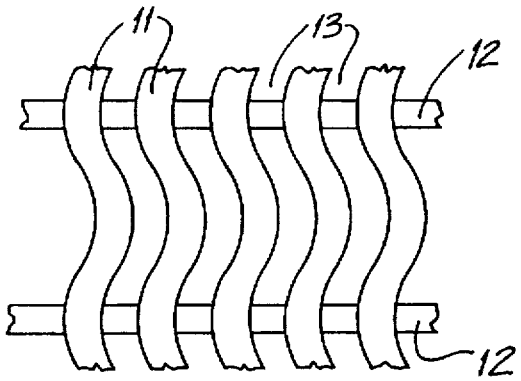
FIGS. 8(*a*)–(*d*) illustrates examples of four possible alternative wave patterns which may be employed in surface member designs.
Figure 8B:
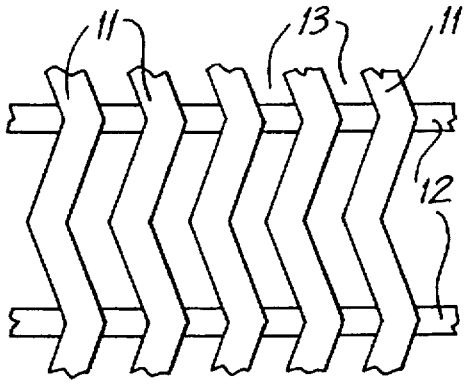
Figure 8C:
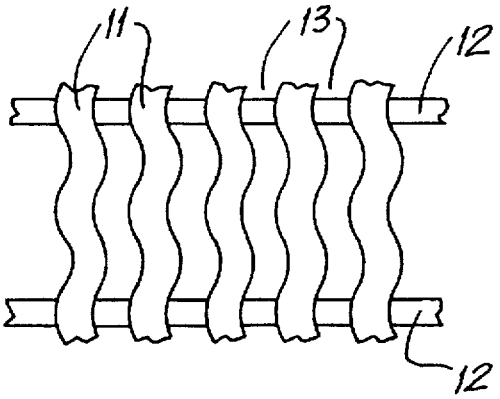
Figure 8D:
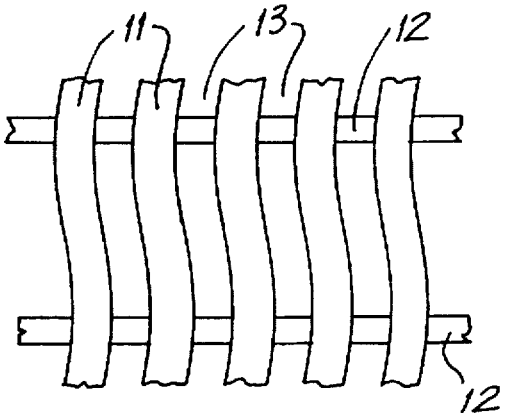
Figure 9:
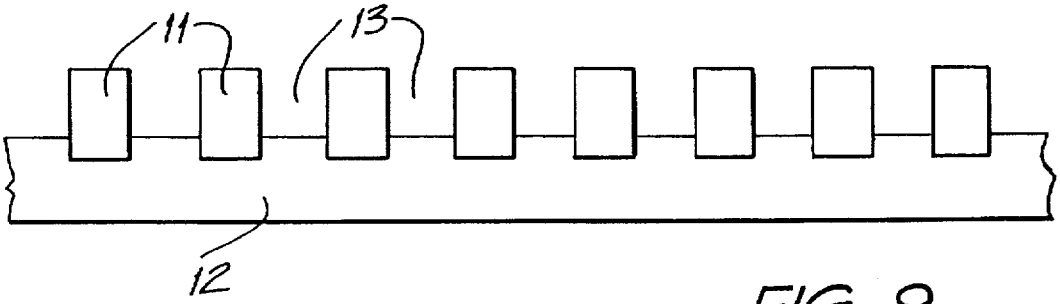
FIG. 9 illustrates a rectangular surface member profile.
Figure 10:
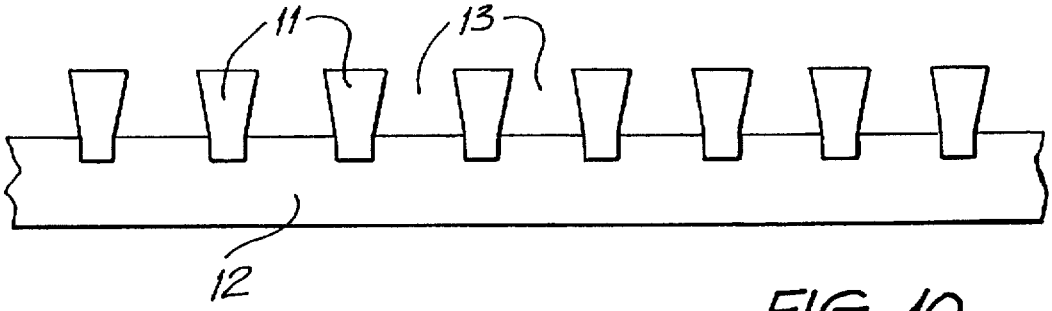
FIG. 10 illustrates a surface member profile tapered over its top two-thirds.
Figure 11A:
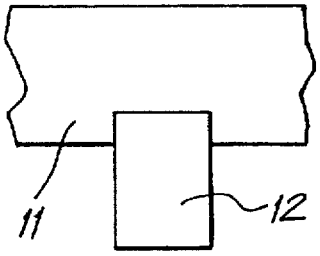
FIGS. 11(*a*)–(*d*) illustrates four different transverse member arrangements.
Figure 11B:
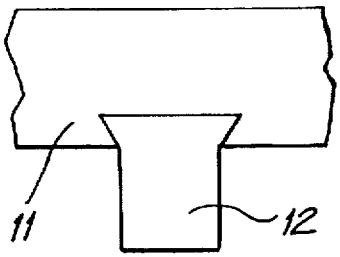
Figure 11C:
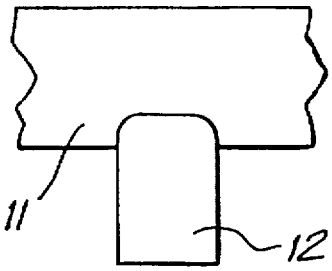
Figure 11D:
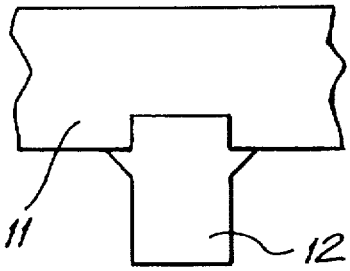

The panels illustrated in FIGS. 6 and 7 show alternative shapes to that of FIG. 5 which will also provide the advantage of improved sizing and clearing characteristics over the embodiment of FIG. 1 in some circumstances. FIG. 6 illustrates surface members 31 and slots 33. FIG. 7 illustrates surface members 41 and slots 43. It will be appreciated that many other surface member shapes will also provide this advantage such as triangular wave shapes, square wave shapes and circular shapes (semi-circular half waves). Examples of some other possible wave shapes are illustrated in FIG. 8 in which FIGS. 8(*a*), (*c*) and (*d*) show various wavelength sine waves and FIG. 8(*b*) shows a triangular wave shape. FIGS. 9 and 10 show examples of possible different surface member profiles which may be effective in some circumstances, including a plain rectangular profile (FIG. 9) and a profile tapered for approximately the two top thirds and then squared at the bottom (FIG. 10). The taper can be in the range of 0° to 13°, for example.

Four examples of cross member profiles are illustrated in FIG. 11 including:

FIG. 11(*a*) a plain rectangular profile;

FIG. 11(*b*) a profile flaired out at its upper end;

FIG. 11(*c*) a profile with champhered or rounded upper corners; and

FIG. 11(*d*) a profile having fillets between the underside of the surface members and the upper sides of the transverse member.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A screen panel for use in vibrating screening equipment, the panel comprising a plurality of screen surface members running in a first direction and a plurality of underlying supporting members running substantially transversely of and connected to each of the surface members to locate the surface members relative to one another and to provide structural strength, each surface member separated from its adjacent surface members by gaps having a dimension defining the discriminating size of the screen panel, and the surface members protruding above the transverse members to provide a plurality of open slots at the surface of the panel over a substantial part of its length, said screen panel being formed of a resilient plastics material and said surface members being constructed so as to be flexible.

2. The screen panel of claim 1 wherein the plastics material is polyurethane.

3. The screen panel of claim 1, wherein the transverse members run generally perpendicular to the average direction of the surface members.

4. The screen panel of claim 1 wherein the transverse members are spaced below the surface of the panel by a distance which is not less than the distance separating the surface members.

5. The screen panel of claim 1 wherein the surface members are not straight.

6. The screen panel of claim 5 wherein the surface members are formed with a regular repeating deviation in the horizontal plane.

7. The screen panel of claim 6 wherein the surface members are formed with a wave pattern having an amplitude which is a small multiple of the gap between the surface members and a wavelength which is approximately an order of magnitude greater than the amplitude.

8. A flexible screen panel for use in vibrating screening equipment, the panel comprising a plurality of resilient plastic screen surface members running in a first direction and a plurality of underlying resilient plastic support members running substantially transversely of and connected to each of the surface members to locate the surface members relative to one another and to provide structural strength, each surface member separated from its adjacent surface members by gaps having a dimension defining the discriminating size of the screen panel, and the surface members protruding above the transverse members to provide a plurality of open slots at the surface of the panel over a substantial part of its length, said resilient plastic screen surface members and underlying supporting members being flexible to provide a horizontal flexibility that is transverse to a direction of material movement on said flexible screen panel, a vertical flexibility, and a twisting flexibility of said surface members about an axis generally aligned with the direction of material movement.

* * * * *